United States Patent [19]

Frentzel et al.

[11] 4,332,288

[45] Jun. 1, 1982

[54] PULL CARRIER FOR VERTICALLY LOUVERED VENETIAN BLIND

[75] Inventors: Kurt H. Frentzel, Zevenhoven; Herman Oskam, Bergambacht, both of Netherlands

[73] Assignee: Hunter Douglas Internation, N.V., Curacao, Netherlands

[21] Appl. No.: 136,951

[22] Filed: Apr. 3, 1980

[30] Foreign Application Priority Data

Apr. 6, 1979 [DE] Fed. Rep. of Germany ..... 2913887

[51] Int. Cl.[3] ..... E06B 9/26

[52] U.S. Cl. ..... 160/176 R; 160/168 R

[58] Field of Search ..... 160/176 R, 177, 174, 160/175, 166 A, 168 R, 178 R

[56] References Cited

U.S. PATENT DOCUMENTS

| | | | |
|---|---|---|---|
| 3,343,588 | 9/1967 | Cayton | 160/176 |
| 3,860,056 | 1/1975 | Bruneau | 160/176 |
| 3,996,988 | 12/1976 | Dewit | 160/168 R |
| 4,103,727 | 8/1978 | Spohr | 160/168 R |
| 4,140,169 | 2/1979 | Arena | 160/178 R |
| 4,267,875 | 5/1981 | Koks | 160/176 R |

FOREIGN PATENT DOCUMENTS

| | | | |
|---|---|---|---|
| 2737145 | 1/1979 | Fed. Rep. of Germany | 160/166 A |
| 1144120 | 3/1969 | United Kingdom . | |
| 1337279 | 11/1973 | United Kingdom . | |
| 1374428 | 11/1974 | United Kingdom | 160/166 A |
| 1529993 | 10/1978 | United Kingdom . | |

*Primary Examiner*—Philip C. Kannan

*Attorney, Agent, or Firm*—Pennie & Edmonds

[57] ABSTRACT

A pull carrier for vertically louvered venetian blinds is disclosed, preferably for use in such blinds having a single drive shaft for transporting the louver carriers along the shaft and also for rotating the louvers about their vertical axes. During rotation of the louvers about their vertical axes by the drive shaft, the pull carrier which effects transport of the louver carriers does not move along the headrail due to a free wheel mechanism comprising a worm and a gear wheel engaged with the worm. The gear ratio of the worm and gear is so selected as to insure that rotation of the louvers about their vertical axes is completed in either of the two opposite directions of rotation before transport of the pull carrier, and subsequently of the louver carriers, can be effected by the drive shaft. Conversely, rotation of the louvers about their vertical axes is avoided during transport of the pull carrier and louver carriers. An overload clutch is provided to protect the blind mechanism when the pull carrier has reached its limit of movement along the headrail in either direction.

7 Claims, 4 Drawing Figures

37
36
34

20
20a
22
23
21
24
21c
21b
21a
11
33a
33b
27
27b
27a
33
28
25
29a
29b
29
40
30
31
32
31
30
24
20
29b
29
33
29a
28
27b
33
28
25
27a
20
23
21
16
15

PULL CARRIER FOR VERTICALLY LOUVERED VENETIAN BLIND

BACKGROUND OF THE INVENTION

1. Field of the Invention

This invention relates, particularly, to venetian blinds having vertical louvers. More specifically, this invention relates to the pull carrier for such a vertical venetian blind, which pull carrier is utilized to transport the louver carriers to the left and the right in the axial direction of a drive shaft which passes through the louver carriers and the pull carrier, and which drive shaft has at least one helical groove.

Still more particularly, the invention relates to a pull carrier which during turning of the louvers about their vertical axes does not exert any lateral traversing action on the louver carriers associated with it.

2. Prior Art

Venetian blinds are well-known, which blinds may have either horizontal or vertical louvers. Blinds of the type having vertical louvers are known in which two drive shafts are provided. One drive shaft serves to rotate the louvers about their vertical axes while the other drive shaft serves to move the louvers left and right of the drive shaft to their closed or open position. Generally, in the opened position the louvers are arranged in two packs, one to the left and one to the right of the window. In their closed position, the two packs of louvers have been arranged substantially equidistantly across the window from left to right rather than in packs with one louver from the left pack and one louver from the right pack being positioned in predetermined spaced relationship to each other in the center of the window. Whether in open, closed, or any intermediate position, the blind must provide for rotation of the louvers about their vertical axes in order to adjust the amount of sunlight passing therethrough. In one position, the louvers are closed and overlap so that no sunlight and no viewing is possible through the window. At the other extreme, the planes of the louvers are arranged substantially perpendicular to the window, whereby there is almost no obstruction to prevent viewing or passage of sunlight. Accordingly, all vertical venetian blinds must be capable of lateral traverse and of vertical rotation about the axes of the individual louvers. While this has commonly been done by two separate drive shafts, there have been vertical blinds with a single drive shaft which performs both the function of rotating the louvers about their vertical axes and also the function of traversing the louvers laterally into packs at the sides, or evenly distributed across the window.

In many applications, the single drive shaft is preferred both for economy and ease of operation. The difficulty arises, however, that the blind must be so constructed as to avoid rotation of the louvers about their vertical axes during transport of the blind and also that traverse of the blind must not take place during rotation of the louvers about their vertical axes.

Heretofore it has been difficult, when using a single drive shaft, to insure that the two functions are adequately separated and do not overlap. Such difficulty has given rise to complicated and expensive mechanisms in order to insure proper operation.

BRIEF SUMMARY OF THE INVENTION

It is, therefore, one object of the present invention to provide a venetian blind having vertical louvers which reliably prevents any lateral transport or traverse during rotation of the louvers about their vertical axes. In accordance with the invention, this object is achieved by a clutch or free wheel mechanism of low friction provided between the pull carrier and the drive shaft, which mechanism permits transport or traverse of the pull carrier only when the rotation of the louvers about their vertical axes in one direction or the other is completely finished.

To this end, a clutch-free wheel mechanism is provided comprising a worm frictionally engaged with the drive shaft, which worm has its single thread engaged with a gear having a stop. The mechanism is so arranged as to rotate the worm and the gear freely without imparting any axial motion to the pull carrier. At the same time, at each louver support carrier a worm is rotating in engagement with a gear in order to rotate the louvers about their vertical axes. The ratio of the worm and gear for the louver turning mechanism is so selected with respect to the ratio of the worm and gear for the free wheeling mechanism in the pull carrier as to insure that after the end of the turning operation for the louvers about their vertical axes, there is at least a small intervening rotation still possible with respect to the worm and associated gear in the pull carrier before the pull carrier worm comes up against the stop on its associated gear. This arrangement provides for rotation of the louver in either direction completely to its limits, followed by a small continued rotation of the drive shaft and the free wheeling mechanism of the pull carrier before the worm in the pull carrier comes up against the stop on its gear, which latter event brings about the lateral traverse of the pull carrier. One way these respective ratios may be achieved is by having the pull carrier worm and the louver carrier worm both of the same pitch while the louver carrier and rotating gear (engaged with its associated worm) may have five or six teeth and the free wheeling gear of the pull carrier may have eight or nine teeth.

DETAILED DESCRIPTION OF THE INVENTION

General Description of the Blind

Figure 1:
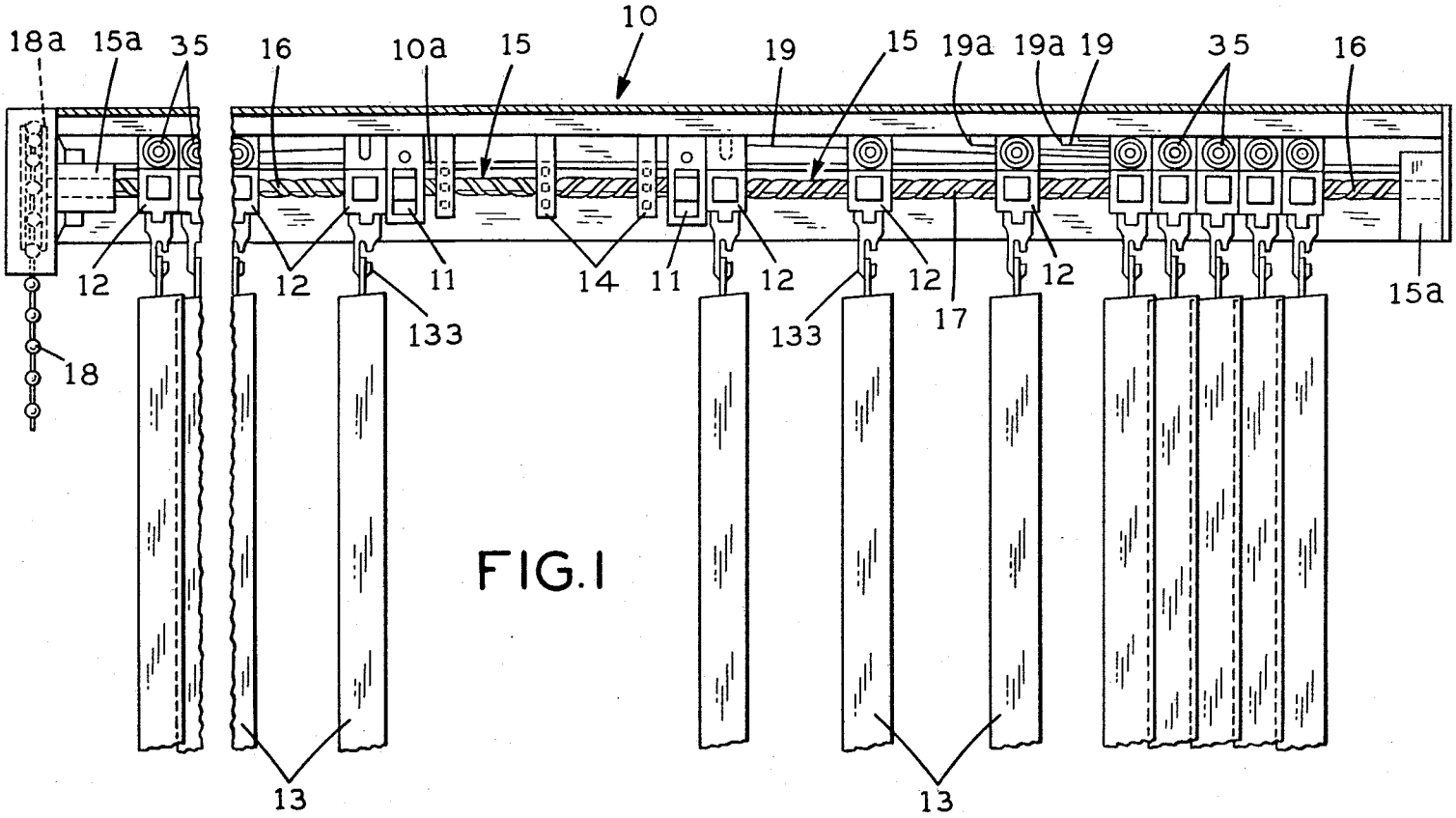
FIG. 1 is a front elevational view of a louvered vertical venetian blind in a diagrammatic representation with the louvers being broken away at their bottoms to reduce the size of the drawing.

As shown in FIG. 1, the vertical louver venetian blind comprises a headrail 10 having on either side thereof on the inner side of the walls spaced tracks 10*a*, only one of which is shown in FIG. 1. Supported from these tracks 10*a* by rollers 35 are a plurality of carriers 12, each of which carries a louver 13 suspended therefrom by a louver holder or hook 133 extending downwardly from the carrier 12.

As most commonly utilized in practice, the louvers 13 and their associated carriers 12 are arranged in two packs, one to the left and one to the right which, when the blind is closed, meet at the center and, when the blind is open, are packed together in two packs, one at the left end and one at the right end of the rail 10.

A drive shaft 15 is mounted within the headrail 10 by means of bearing blocks 15*a* at or adjacent the ends of the shaft 15 and also by means of intermediate supports 14 through which the drive shaft 15 extends. The intermediate supports 14 are provided in order to prevent any sagging of the drive shaft 15. Depending upon the length of the headrail 10, the intermediate supports 14 may be fixed relative to the rail 10 or, alternatively, may themselves be designed to be traversed along the length of the drive shaft in order to provide strength where needed. In this latter case, they would be constructed similarly to the carriers 12, in that they would have rollers supported upon the tracks 10*a*. The drive shaft 15 also extends through a pair of pull carriers 11, one of which is associated with each of the two packs of carriers 12. The drive shaft 15 has three helical grooves. The grooves 16 on one-half of the shaft 15 are opposite to the grooves 17 on the other half of the drive shaft 15. Each of the pull carriers 11 has within it means 21, 21*a*, 21*b*, 21*c* (FIG. 2) for engaging the three helical grooves 16 or 17 in the drive shaft 15 for sliding engagement along the drive shaft upon rotation thereof. As will be apparent from FIG. 1, upon rotation of the drive shaft 15, one of the pull carriers 11 (the one to the right in the figure) will move to the right away from the other pull carrier 11 (the one to the left) which will move to the left due to the different and opposite direction of the three helical grooves 16 with respect to the three helical grooves 17. Each of the pull carriers 11 is also connected securely to the first adjacent carrier 12 of its associated pack of carriers 12. Accordingly, when the pull carriers 11 move from the center toward the ends of the headrail 10, they will carry with them the first associated carrier in each pack until they reach the next carrier, at which point they will carry both the first and second carrier 12 along with them until they reach the third carrier 12 and move it along as well and so on, picking up each carrier in succession and moving it toward the end. When the drive shaft 15 is driven in the opposite direction, the pull carrier 11 and the first louver carrier 12 to which it is secured will be moved from the end position toward the center position. When pull carrier 11 and its connected louver carrier 12 have moved together toward the center a predetermined distance, the carrier 12 will engage the stop 19*a* of a spacer member 19. Each of the louver carriers 12, except for the first ones which are connected to the pull carrier 11, has secured thereto at one end an elongated metal strip 19 which extends to and through the next adjacent louver carrier 12 toward the center. This elongated metal spacer strip 19 determines the spacing between adjacent louver carriers 12 and, thus, between the louvers 13. The spacer 19 extends through in sliding relationship with the next adjacent carrier 12 that is on that side toward the center. When a carrier 12 reaches the end of the spacer 19, it engages the up-turned stop 19*a* and, thus, pulls the next succeeding carrier 12 along, which next succeeding carrier 12 is fixed to the opposite end (opposite to the end 19*a*) of the spacer member 19. In this way, the blind, when closed, insures that the individual louvers 13 are evenly spaced while at the same time permitting them to pack together at the ends when opened.

At one end of the shaft 15 is a bead chain pulley 18*a* secured thereto and around which is engaged a bead chain 18 for operating the blind by rotating the drive shaft 15.

Pull Carrier and Its Free Wheeling and Clutch Mechanism

Figures 2, 3:
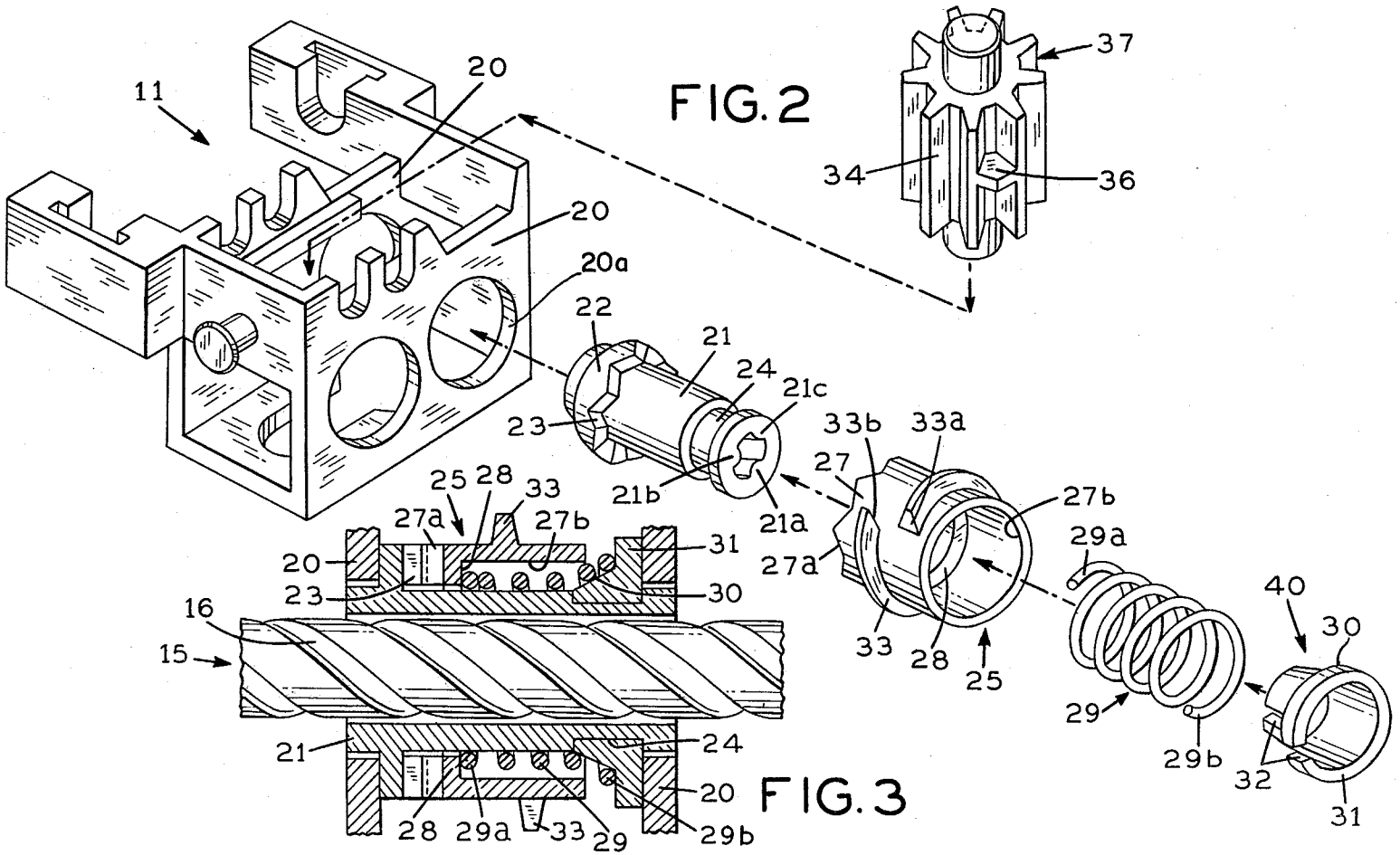
FIG. 2 shows an exploded view of a pull carrier and its essential components.
FIG. 3 shows a vertical cross-section through a part of the pull carrier.

With reference now to FIGS. 2 and 3, it will be seen that the pull carrier 11 has a casing 20 having openings 20*a* through which the drive shaft 15 passes. A sleeve 21 surrounds the drive shaft 15 and, at least at one end, has a shape including three inwardly extending lobes 21*a*, 21*b* and 21*c* which engage in the three grooves 16 of the drive shaft 15, thus, providing a positive connection between the sleeve 21 and the drive shaft 15. At one end, the sleeve 21 has an integral flange 22 having integral teeth 23 extending in an axial direction toward the opposite end of the sleeve 21. Adjacent its other end, the sleeve 21 has a groove 24. A spring 29 of the coil-type encircles the sleeve 21 and is itself encircled by the hub 27 of a worm 25.

In assembling the parts of the free wheeling and clutch mechanism, the worm 25 is first placed over the sleeve 21 concentric therewith and with its teeth 27*a* in engagement between the teeth 23 of the sleeve 21. The worm 25 has a radially, inwardly extending shoulder 28 dimensioned to fit loosely about the sleeve 21. The internal cylindrical wall 27*b* of the hub 27 is sufficiently large to receive coil spring 29 which is itself sufficiently large to encircle the sleeve 21. Accordingly, at the end 29*a* of coil spring 29, the coil spring bears against the shoulder 28 of worm 25.

Positioned within the groove 24 is a flanged journal-like member 40 having a hub 30, a flange 31 and a slot 32 extending parallel to the axis of the journal-like member 40 throughout the length of the hub 30 and the flange 31. As shown in FIG. 3, the hub portion 30 of the journal-like member 40 has a generally conical shape about which is positioned the end 29*b* of the coil spring 29.

By virtue of the engagement of the end 29*a* of the spring 29 against the shoulder 28 while the end 29*b* of the spring 29 is substantially fixed axially, the spring 29 serves to maintain the teeth 27*a* of the worm 25 resiliently but firmly engaged between the teeth 23 of the sleeve 21. At its opposite end 29*b*, the coil spring 29 is engaged about the conical hub 30 and serves to squeeze the journal-like member 40 to reduce the size of the slot 32, thus, maintaining the journal-like member 40 firmly engaged within the groove 24 of the sleeve 21. Accordingly, on the one hand, the coil spring 29 resists disengagement of the journal-like member 40 from the groove 24 by tending to ride ever further upward on the conical surface of hub 30, thus, affecting a squeeze action to further insure engagement of the journal-like member 40 with the groove 24. On the other hand, and simultaneously, the end 29*a* bears against the shoulder 28 of the worm 25 serving to insure engagement of the teeth 27*a* between the teeth 23 of the sleeve 21.

Operation of Pull Carrier

Operationally, rotation of the drive shaft 15 effects rotation of the sleeve 21 due to the engagement of the lobes 21*a*, 21*b* and 21*c* with the helical grooves 16 of the drive shaft 15. Rotation of the sleeve 21 effects rotation of the worm 25, coil spring 29 and journal-like member 40 due to the engagement of the teeth 23 on sleeve 21 with teeth 27*a* on worm 25. This rotation also rotates worm thread 33. Worm thread 33 is in engagement with teeth 34 of a gear 37. Gear 37 rotates nothing. Its sole purpose is to serve as a timing or position controller and, to this end, it has a stop 36 positioned between two adjacent teeth 34.

When drive shaft 15 is operated, worm 25 will be rotated as above described and gear 35 will be rotated due to engagement between the worm thread 33 and the teeth 34. This comprises a free wheeling rotation in which no actual work is accomplished. Eventually, either the face 33*a* or the face 33*b* (depending upon the direction of rotation) will come into engagement with the stop 36. At this point, the engagement between the lobes 21*a*, 21*b* and 21*c* of the sleeve 21 with the grooves 16 will cause the sleeve 21 to move along the drive shaft 15, either to the left or to the right depending upon the direction of rotation. This transport of the sleeve 21 effects traverse of the entire pull carrier 11 due to the engagement of the flange 22 at one end and the flange 31 at the other end of the sleeve 21 with the walls 20 of the carrier 11.

Louver Rotation Mechanism

Figure 4:
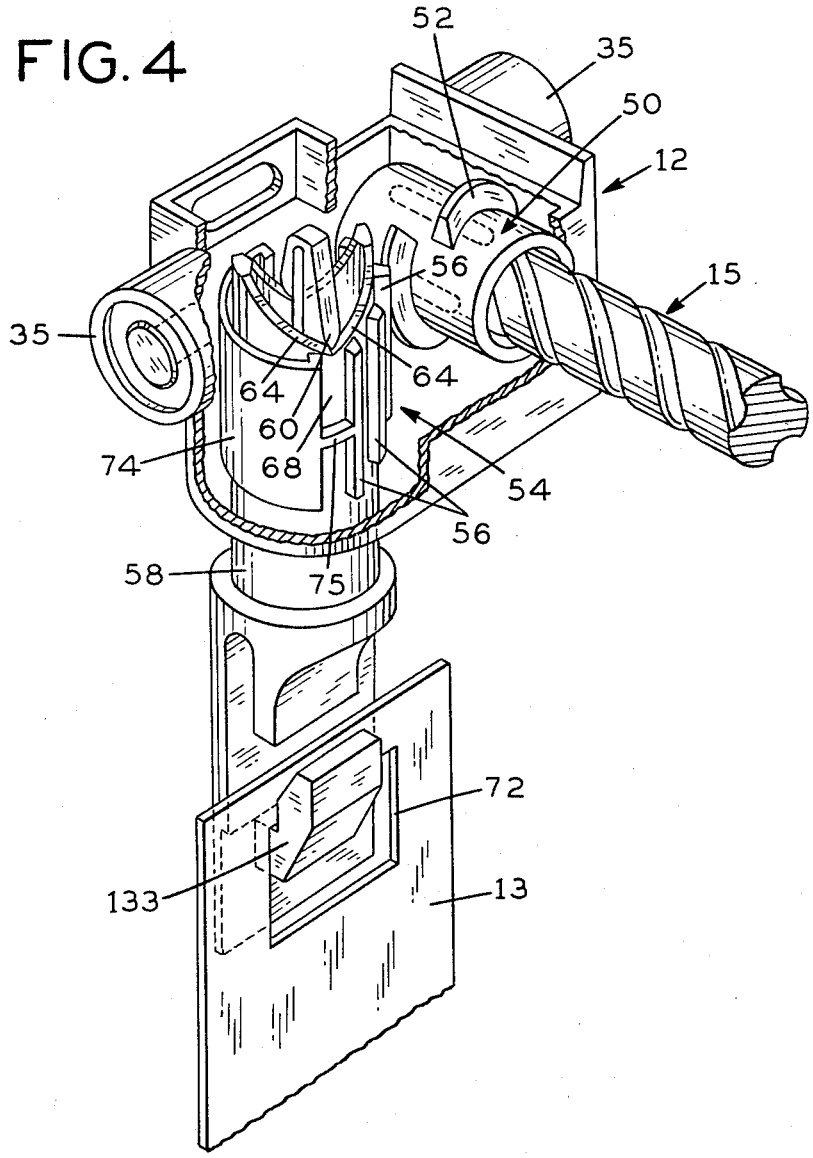
FIG. 4 shows the drive mechanism for rotating a louver about its vertical axis.

The mechanism for rotating a louver about its vertical axis is shown in FIG. 4 removed from its associated louver carrier casing 12. The drive shaft 15 extends through the carrier 12 through openings provided therein. Within the carrier 12, the drive shaft has frictionally engaged thereabout a worm gear 50 having a single worm thread 52. The worm thread 52 is in engagement with a gear 54 having teeth 56 thereon. The gear 54 is mounted in the carrier 12 for rotation in a position such that its teeth 56 are engaged by the worm thread 52. A louver support 58 extends upwardly through the bottom wall of carrier 12 and extends through the hollow interior of gear 54. At its top, holder 58 has laterally projecting ears 60 which rest upon the upper edge 64 of the hub 68 of the gear 54. For reasons not relevant here, the upper edge 64 is shaped somewhat like a cam track with two lower points and two higher points as shown. The projections 60 normally rest in the low points of the upper edge 64 as shown. Accordingly, rotation of drive shaft 15 will rotate worm 50 which, in turn, will rotate gear 54 by virtue of the engagement between the worm thread 52 and teeth 56 on gear 54. Rotation of gear 54 will cause rotation of hanger 58 due to the engagement of the projections 60 in the low points of the upper edge surface 64. On its lower end, hanger 58 has a hook 133 engaged in an opening 72 of a louver 13 in order to support and rotate the same.

As will be seen from FIG. 4, the teeth 56 do not extend entirely around the circumference of the gear 54 but, rather, only a portion thereof. In practice, the teeth 56 are present only around approximately 180° (measured from the centerline of the first tooth to the centerline of the last tooth) of the circumference of the gear 54. A blank untoothed portion 74 occupies most of the remainder of the circumference of the gear 54. On each side of the blank untoothed portion 74 is a stop 75 extending between the untoothed portion 74 and the next adjacent tooth 56.

Further Description of Operation

During the time when the drive shaft 15 is rotating and carrying with it the sleeve 21, worm 25, coil spring 29 and journal-like member 40, the pull carrier 11 will remain stationary. However, during this time the drive shaft 15 will be rotating all of the louvers 13 through their associated worm 50 and worm gear 54. Because the pitch of worm thread 52 is substantially the same as that of worm thread 33 on the pull carrier and the diameter of the gear 37 is substantially the same as that of gear 54 and each has teeth of the same size and pitch, each gear 37 will turn through an arc equal to that of gear 54. This rotation of gears 37 and 54 continues until one end of the worm 52 comes up against one of the stops 75. At this point, further rotation of gear 54 is prevented, but because the drive shaft 15 is only frictionally engaged within the worm gear 50, the drive shaft 15 may continue to rotate even though worm gear 50 and gear 54 will no longer rotate. During this continued rotation of drive shaft 15, worm gear 25 will continue to drive gear 37 until one end 33*a* or 33*b* of worm thread 33 comes up against stop 36. When this occurs, further rotation of worm 25 and gear 37 is arrested and the forces exerted by the drive shaft 15 on the sleeve 21 through the lugs 21*a*, 21*b* and 21*c* causes the lugs to "thread" themselves along drive shaft 15, thus effecting traverse of the pull carrier 11.

Lateral movement (traverse) of the pull carrier 11 carries with it the first louver carrier 12 to which it is secured. When the movement is in the direction to open the blind, this movement of the pull carrier 11 and its associated louver carrier 12 is a movement away from the center of the window, which movement soon brings the first louver carrier 12 into contact with the next adjacent louver carrier 12, thus, causing it to move axially along the drive shaft as well. As this movement continues, each succeeding louver carrier 12 is "picked up" and moved along with the pack until all of the louvers are assembled together at the lateral edge of the window (the end of the blind).

At this point, further operation of the drive shaft 15 can no longer move either the pull carrier 11 or the louver carriers 12 since they have already been drawn together in a pack and the last of which is bearing against a stop. Accordingly, further force applied in this direction to the drive shaft 15 will be imparted to the sleeve 21 which will attempt to continue to rotate. This attempt at continued rotation overcomes the bias of the spring 29 and causes the teeth 23 to slip over the teeth 27*a* providing a clutching action. When an operator hears these teeth snapping over one another, he knows that the pull carrier associated therewith has reached the limit of its movement. The other pull carrier, however, may not yet have quite reached its limit. If this is the case, the operator will continue rotation of the drive shaft 15 in the same direction until the second pull carrier also begins to exhibit the snapping noise associated with having reached its limit as the teeth 27*a* and the teeth 23 slip past each other. When both pull carriers 11 are exhibiting this action, then, at that point, the venetian blind has reached the limit of its outward opening capacity. Also, at this point, both packs of blinds 13 will have been assembled in the tightest possible pack on either side of the window.

If now the drive shaft is rotated in the opposite direction, then, in that event, no further force will be applied tending to make the teeth 27*a* and the teeth 23 slide over each other. To the contrary, free wheeling rotation of the worm 25 and the gear 37 will now again take place. Upon the commencement of rotation of the drive shaft 15 in this other direction, the worm 50 will again frictionally engage drive shaft 15 causing worm 50 and gear 54, within each of the louver carriers 12, to begin rotation of the louvers 13 about their vertical axes in the direction opposite to that earlier described. Continued rotation of the shaft 15 in this other direction will continue to rotate the louvers 13 about their vertical axes until, again, the other end of worm 52 comes up against the other stop 75. At this time, as before, the shaft 15 may rotate within worm 50 due to its frictional engagement therewith and rotation of the worm 50, gear 54 and louver 13 is arrested. Rotation of worm 25 and gear 37 continues for a short time, however, until the opposite end (opposite to that previously described) of worm 33 comes up against stop 36. At this point the forces applied by the drive shaft 15 to the ears 21*a*, 21*b* and 21*c* again causes them to "thread" their way along the shaft 15 carrying the pull carrier 11 therewith. This movement of the carrier 11 along the drive shaft 15 will be in a direction opposite to that previously described, i.e. toward the center.

This movement of the pull carriers 11 toward the center carries along the first louver carrier 12 in each pack. Shortly, however, each louver carrier 12 comes up against a stop 19*a* of spacer member 19 which causes the spacer member 19 to move along with the louver carrier 12. At its end opposite to the stop 19*a*, each spacer 19 is fixed to the next succeeding louver carrier 12. Accordingly, the next succeeding louver carrier 12 will be pulled along by its associated spacer 19 and the preceding louver carrier 12 until the louvers are spread out in the desired spaced relationship across the window. Again, when one of the pull carriers 11 has reached its traverse toward the center, it will come up against a suitable stop which may be the other louver carrier 11, a support carrier 14, or a special stop provided for the purpose. Having reached its limit of traverse, the pull carrier 11 cannot move further even upon further rotation of the shaft 15. Rather, further rotation of the shaft 15 causes the declutching effect previously described between the teeth 23 and the teeth 27*a*. If both pull carriers 11 have not arrived simultaneously at the center, one will reach it first and rotation of the shaft 15 will effect the slipping over of the teeth 27*a* with respect to the teeth 23 which the operator will hear. He will then continue operation until this has occurred at both pull carriers 11 whereupon he will stop rotation of the shaft 15.

Not only may the vertical louvers be adjusted about their vertical axes at the two extreme positions of the blind (open and closed) but, also, the louvers may be adjusted about their vertical axes at any intermediate point between these two extremes. However, when the limit of rotation of the louvers about their vertical axes is reached in either direction, then, in that event, the pull carriers 11 will begin to traverse along the axis of the shaft 15.

To insure the proper timing of the traverse of the pull carriers 11 in order to avoid any overlap with rotation of the louvers about their vertical axes, the ratio of the worm 25 to the gear 37 is selected to be different from the ratio of worm 50 to gear 54 provided for each louver. Gear 37 may have eight or nine teeth while the gear 54 for the louver carrier 12 may have five or six teeth. With this arrangement, the gear 54 for supporting and rotating the louvers 13 will complete its rotation with less rotation of the drive shaft 15 than will the gear 37. This difference allows the louvers to be turned to their limit in either direction prior to engagement of the stop 36 by one of the faces 33*a*, 33*b* of the worm 25 as above described.

In addition to the construction described in "Further description of Operation" another solution falling clearly within the framework of the invention is that the difference in ratios of the worm 25 to the gear 37 and worm 50 to gear 54 can also be obtained by fully toothed gears 37 and 54 having different numbers of teeth and/or the pitch of the worms 25 and 50 being different.

We claim:

1. In a louvered venetian blind having a headrail, a plurality of louver carriers mounted in said headrail for movement therealong, a plurality of vertically disposed louvers each supported from one of said louver carriers, a pull carrier for moving the louver carriers along said headrail, drive means for rotating said louvers about their vertical axes and for moving said pull carrier and said louver carriers along said headrail, the improvement comprising said louvers being rotatable about their axes in either direction, stop means for stopping said rotation of said louvers in each direction, a free wheel mechanism carried by said pull carrier driven by said drive means, means for moving said pull carrier along said headrail after said stop means has stopped the rotation of said louvers about their vertical axes in one of said directions, and means for disconnecting said free wheel mechanism from said drive means to prevent movement of said pull carrier along said headrail during all times when said louvers are being rotated about their vertical axes.

2. A venetian blind in accordance with claim 1, in which said drive means includes a drive shaft, at least one helical groove in said drive shaft, said free wheel mechanism including a first worm having a portion slidably engaged in said helical groove of the drive shaft, a gear wheel engaged with said worm and mounted for rotation in either of two opposite directions, second stop means on said gear wheel for stopping the rotation of the worm in each direction after a predetermined number of revolutions, the gear ratio between the worm and the gear wheel being such that the number of revolutions of the shaft required to rotate the worm from stop to stop is greater than the number of revolutions of the shaft required for rotation of the louvers from stop to stop.

3. A venetian blind in accordance with claim 2, including a turning mechanism in each louver carrier driven by said drive shaft for rotating its associated louver about its vertical axis, said turning mechanism comprising a second worm engaged with said shaft and driven thereby, said turning mechanism also including a second gear wheel engaged and driven by said second worm and positioned coaxially of the vertical rotational axis of the louver, both of said worms having the same pitch, and the number of teeth of said first mentioned gear wheel being greater than the number of teeth of said second mentioned gear wheel.

4. A venetian blind in accordance with claim 3, including an overload clutch operative to drive said first worm from said drive shaft, and said overload clutch being operative to drivingly disengage said drive shaft from said first worm when said first worm has been stopped by the stop on said first mentioned gear wheel and the pull carrier has reached the limit of its movement along said headrail.

5. A venetian blind in accordance with claim 4, in which said overload clutch includes a sleeve on said drive shaft, a portion of said sleeve being engaged in said helical groove, said first worm having a hub surrounding said sleeve, a first ring of teeth on said sleeve, a second ring of teeth on said hub normally resiliently engaging said first ring of teeth.

6. A venetian blind in accordance with claim 5, in which said first worm hub is spaced radially outwardly of said sleeve, a coil spring surrounding said sleeve and within said hub, an annular ring on the interior of said hub extending radially inward toward said sleeve, the opening formed by said annular ring, and the normal resilient engagement between said rings of teeth being effected by said spring.

7. A venetian blind in accordance with claim 6, in which said first ring of teeth on said sleeve are adjacent one end thereof, an annular groove adjacent the opposite end of said sleeve on the exterior thereof, an annular member seated in said groove, said annular member being slotted throughout its length parallel to its axis, said annular member including a frusto-conical portion, the end of said spring being opposite to said one end being engaged about said frusto-conical portion in such a manner as to squeeze said annular member and reduce the circumferential width of the slot therein.

* * * * *

UNITED STATES PATENT AND TRADEMARK OFFICE

CERTIFICATE OF CORRECTION

PATENT NO. : 4,332,288

DATED : Jun. 1, 1982

INVENTOR(S) : Kurt H. Frentzel and Herman Oskam

It is certified that error appears in the above-identified patent and that said Letters Patent is hereby corrected as shown below:

On the Title Page, at [73] Assignee: line 2

"Curacao, Netherlands" should read --Curacao, Netherlands Antilles--.

Signed and Sealed this

Seventeenth Day of May, 1988

*Attest:*

DONALD J. QUIGG

*Attesting Officer*

*Commissioner of Patents and Trademarks*